US007997202B2

(12) United States Patent
Peters et al.

(10) Patent No.: US 7,997,202 B2
(45) Date of Patent: Aug. 16, 2011

(54) WEB OFFSET PRINTING PRESS AND METHOD FOR OPERATING A WEB OFFSET PRINTING PRESS

(75) Inventors: Klaus Peters, Lohr am Main (DE); Dieter Staub, Rechtenbach (DE)

(73) Assignee: Bosch Rexroth AG, Stuttgart (DE)

( * ) Notice: Subject to any disclaimer, the term of this patent is extended or adjusted under 35 U.S.C. 154(b) by 0 days.

(21) Appl. No.: 12/327,071

(22) Filed: Dec. 3, 2008

(65) Prior Publication Data

US 2009/0078142 A1 Mar. 26, 2009

Related U.S. Application Data

(62) Division of application No. 11/543,360, filed on Oct. 5, 2006.

(30) Foreign Application Priority Data

Oct. 7, 2005 (DE) ..... 10 2005 048 472

(51) Int. Cl.

| | |
|---|---|
| ***B41F 5/04*** | (2006.01) |
| ***B41F 13/02*** | (2006.01) |
| ***B41F 1/34*** | (2006.01) |
| ***B41F 21/12*** | (2006.01) |
| ***B41F 21/14*** | (2006.01) |
| ***B41F 1/54*** | (2006.01) |
| ***B41F 1/66*** | (2006.01) |
| ***B41L 1/02*** | (2006.01) |
| ***B41L 5/12*** | (2006.01) |
| ***B41L 39/00*** | (2006.01) |
| ***B41L 47/56*** | (2006.01) |

(52) U.S. Cl. ..... 101/485; 101/484; 101/219; 101/227

(58) Field of Classification Search ..... 101/227, 101/224, 226, 220, 228, 225, 219, 216, 485, 101/484, 486

See application file for complete search history.

(56) References Cited

U.S. PATENT DOCUMENTS

| | | | | |
|---|---|---|---|---|
| 4,552,066 | A | 11/1985 | Giori et al. | 101/152 |
| 4,872,247 | A | 10/1989 | Nakamura et al. | 492/40 |
| 5,117,753 | A | 6/1992 | Mamberer | 101/225 |
| 5,309,834 | A | 5/1994 | Koch | |
| 5,481,971 | A | 1/1996 | Grutzmacher et al. | 101/183 |

(Continued)

FOREIGN PATENT DOCUMENTS

| | | |
|---|---|---|
| DE | 102 43 454 | 4/2004 |

(Continued)

*Primary Examiner* — Daniel J Colilla
*Assistant Examiner* — Leo T Hinze
(74) *Attorney, Agent, or Firm* — Michael J. Striker

(57) ABSTRACT

A web offset printing press that prints and processes at least one material web and has printing units and/or printing unit assemblies, at least one folder, and transport elements operates by transporting the at least one material web by the transport elements through a web of the printing press into the at least one folder, electrically driving the at least one folder, the printing units and/or printing unit assemblies and the transport elements at least partially mechanically independently of each other, and synchronizing during printing operation via specified setpoints values of at least one master axis with an electronically generated synchronization clock, and starting from a initial state of the at least one folder in which the master axis and/or condition of motion of the folder are independent of each other, adapting by the at least one folder its initial state to or synchronizing by the at least one folder its initial state with setpoint value assignments of the master axis, by performing compensating motions.

14 Claims, 2 Drawing Sheets

Basic design of a shaftless drive system for two sub-machines A+B (sections), each having several webs, with sectional motion control systems and group control systems

U.S. PATENT DOCUMENTS

| | | | | |
|---|---|---|---|---|
| 5,615,609 | A | 4/1997 | Hill et al. | 101/183 |
| 5,873,307 | A | 2/1999 | Tenfelde et al. | 101/248 |
| 5,901,647 | A | 5/1999 | Kohlmann | 101/216 |
| 5,924,362 | A | 7/1999 | Volz et al. | 101/183 |
| 5,947,023 | A | 9/1999 | Bohrer et al. | 101/181 |
| 6,281,645 | B1 | 8/2001 | Matsukawa | 318/112 |
| 6,427,590 | B1 | 8/2002 | Rossler et al. | 101/181 |
| 6,446,553 | B1 | 9/2002 | Costin et al. | 101/183 |
| 6,539,860 | B2 | 4/2003 | Tsunashima et al. | 101/181 |
| 6,679,172 | B2 | 1/2004 | Tokiwa | 101/484 |
| 6,823,792 | B2 | 11/2004 | Grutzmacher et al. | 101/483 |
| 6,914,402 | B2 | 7/2005 | Gabler et al. | 318/560 |
| 7,159,514 | B2 | 1/2007 | Eckert et al. | 101/227 |
| 7,448,321 | B2 | 11/2008 | Rugamer | 101/216 |
| 2004/0133287 | A1 | 7/2004 | Gabler et al. | 700/56 |
| 2005/0284316 | A1 | 12/2005 | Rugamer | 101/216 |

FOREIGN PATENT DOCUMENTS

| | | |
|---|---|---|
| EP | 0 930 552 | 7/1999 |
| WO | 97/11848 | 4/1997 |
| WO | WO 2004028805 A1 | 4/2004 |

WEB OFFSET PRINTING PRESS AND METHOD FOR OPERATING A WEB OFFSET PRINTING PRESS

CROSS-REFERENCE TO A RELATED APPLICATION

This application is a divisional application of U.S. patent application Ser. No. 11/543,360 filed on Oct. 5, 2006. This application therefore claims the benefit of priority of U.S. patent application Ser. No. 11/543,360 under 35 USC 119(e) and the subject matter of U.S. application Ser. No. 11/543,360 is explicitly incorporated herein by reference thereto.

The invention described and claimed hereinbelow is also described in German Patent Application DE 10 2005 048472.7 filed on Oct. 7, 2005. This German Patent Application, whose subject matter is incorporated here by reference, provides the basis for a claim of priority of invention under 35 U.S.C. 119(a)-(d),

BACKGROUND OF THE INVENTION

The present invention relates to a method for operating a web offset printing press.

A web offset printing press of this type prints and processes at least one material web, e.g., paper, and newsprint in particular, e.g., for a daily newspaper. To print, printing units and/or printing unit assemblies are provided, in which driven impression cylinders print material webs. "Processing" can refer, e.g., to perforating, or the subsequent cutting, folding, and assembling in a folder, and is also a component of web offset printing press according to the present invention. Further transport elements are also provided to transport the at least one material web through the web offset printing press into the at least one folder, which represents the end and completion of a particular production run. These further transport elements can be, e.g., drawing rollers in the superstructure upstream of the folders, merging drawing rollers in the folder, draw-in mechanisms, or reel changers. In general, "transport element" is intended to mean an element that guides and/or transports and/or directs the material web, and or that interacts with the material web, and/or stores the material web, e.g., stores it dynamically, or a reel changer, which contains, e.g., a paper roll with the rolled-up material web for use in production.

The inventive web offset printing press includes at least one folder, printing units and/or printing unit assemblies, and transport elements, which are electrically driven at least partially mechanically independently of each other. As a result, some or all of the elements/assemblies listed are not coupled with each other by a mechanically continuous shaft. Instead, they are electrically driven by several electrical drives (composed, e.g., of a driving unit and an electric motor) that operate mechanically independently of each other. During printing operation, the elements/assemblies listed are synchronized with an electronically generated synchronization clock using setpoint value assignments from at least one master axis.

The master axis can be, e.g., a kinematic reproduction of "virtual" mechanical shaft, which would mechanically couple the elements listed above. The synchronization clock can be generated and distributed in real time, both in terms of time and with regard for the accuracy of the position/motion setpoint value. The highly exact master axis signal, which can be composed, e.g., of position setpoint values, speed setpoint values, or other motion-relevant setpoint values in a temporally predetermined sequence, is preferably distributed via a real-time bus to the various elements and/or assemblies. This will be discussed in greater detail below.

A known method for web offset printing presses with one or more webs, with, e.g., individually driven printing units or printing unit assemblies, one or more individually driven folders, further processing stations, which are not described further, and individually driven drawing rollers in the superstructure upstream of the folders, individually driven merging drawing rollers in the folder, individually driven draw-in elements, individually driven reel changers, all individual drives on the webs that are transported into the same folder, are assigned to a "virtual production master axis", so they can be followed in electronic angular-locked synchronization.

A virtual master axis is the position reference ($\phi_{LA}$=position setpoint) for the assigned individual drives, which is calculated in a control system and moves in proportion with the desired machine speed. This position reference is transmitted to the drives simultaneously (synchronously) via rapid realtime bus systems and, optionally, via further, intermediately connected assembly control systems. The individual drives follow this position setpoint with the aid of their own digital position control. To adjust the angular position of the individual drives relative to the web that is passing through them, an individual angular offset $\Delta\phi_i$ is also calculated for each individual drive, and it is added to the current master axis position. The total position setpoint of an individual drive is therefore defined as $$\phi_i=(\phi_{LA}+\Delta\phi_i)$$

The calculation of the individual values for the angular offset $\Delta\phi_i$ is carried out, e.g., in control station computers with knowledge of the selected web travel for production, and of the web paths covered between the individually driven processing stations. The transmission of the offset values is also carried out via a suitable data bus between the control stations and the control systems of the drive system.

For printing unit assemblies, the angular offset values of the drives is calculated such that color printing with precise register results, for driving the folder, e.g., an angular offset $\Delta\phi_F$, which brings the cutting cylinder into the desired position for the cutting register (position of the dividing cut at the start of a page).

Basically, the control system for the drives must move all individual drives at the processing stations into these positions in accordance with the angular offset values for the correct register. This takes place preferably before the start of production, to prevent waste (preset, default machine settings).

In the "Dezentralen Antriebssystem zur Synchronisierung von wellenlosen Druckmaschinen" [Decentralized Drive System for Synchronizing Shaftless Printing Presses] from Bosch Rexroth Electric Drives and Controls GmbH, this task is carried out automatically (by the drives) in the individual drives of the system via the "dynamic synchronization" function:

The drives move automatically—guided by the drives—based on a command, from any starting position into the target position=current master axis position+angular offset, $$\phi_i=(\phi_{LA}+\Delta\phi_i).$$

For this procedure, it does not matter if the master axis $\phi_{LA}$ is still at a standstill, or if the master axis (and, therefore, the individual drives and the entire machine) is already in motion. To elucidate the basic process, FIG. 2 shows the speeds that occur during "dynamic synchronization".

Whether and when during the course of preparation and start-up of a machine these motions for synchronization can be carried out is therefore not determined by the properties of the drive system, but rather by the special basic conditions and limitations of the processing process in the machine:

The printing units in the machine of the type described can be synchronized at any time, provided they are still in the "impression throw-off" position, i.e., the impression cylinder has not yet come in contact with the printing stock (web).

Publication DE 102 43 454 B4 makes known a method of the type described initially, which provides that the current actual value position of the folder is used as the starting value for the "virtual" master axis. The disadvantage is that practically the entire printing press can contain initial-motion setpoint values that are unfavorable and that deviate from the current position or the current condition of motion of many elements; in addition, a method of this type lacks flexibility and responsiveness, and is limited in terms of possible configurations, because it is designed for use with only one folder. With this method, the dynamic performance is also relatively inaccurate and very limited; the entire system of the web offset printing press that operates with this method—in accordance with the mechanical limitations of the folder—must therefore be started up very slowly, to prevent the web from tearing.

In addition, this method of setting the starting position can only be used when each of the webs—with the assigned printing units or printing unit assemblies—is conveyed into only one folder.

This method cannot be used in production situations in which, after the web is printed by one printing unit assembly, it is separated and transported to two different folders. According to the method described, the master axis position for this printing unit assembly can only be set to the position of a first folder. The second folder must then be synchronized with the target position of the production master axis—with its default settings—with addition of the calculated angular offset for its particular cutting register.

SUMMARY OF THE INVENTION

The object of the present invention, therefore, is to increase the dynamic performance of the web offset printing press.

A further object of the present invention is to increase the flexibility of the machine configurability.

A further object of the present invention is to ensure greater overall accuracy.

A further object of the present invention is to prevent or at least reduce mechanical limitations, which are due, in particular, to the complex mechanics of a folder.

Finally, the means of attaining the object of the invention has the objective of enabling a folder to be synchronized with values of angular offset $\phi_F$, to adjust the cutting register of already drawn-in webs, given any virtual master axis positions, and to complete this procedure as quickly as it takes to synchronize the printing units.

In keeping with these objects and with others which will become apparent hereinafter, one feature of the present invention resides, briefly stated, in a method of operating a web offset printing press that prints and processes at least one material web, comprising the steps of providing printing units and/or printing unit assemblies, with at least one folder, and with transport elements; transporting the at least one material web by the transport elements through a web of the printing press into the at least one folder; electrically driving the at least one folder, the printing units and/or printing unit assemblies and the transport elements at least partially mechanically independently of each other, and synchronizing during printing operation via specified setpoints values of at least one master axis with an electronically generated synchronization clock; and starting from an initial state of the at least one folder in which the master axis and/or condition of motion of the folder are independent of each other, adapting by the at least one folder of its initial state to and synchronizing by the at least one folder of its initial state with setpoint value assignments of the master axis by performing compensating motions.

The present invention offers the advantage that the dynamic performance and the flexibility of the configurability of the web offset printing press are increased. At the same time, a more consistent reference control and more consistent operation of the web offset printing press are ensured by the fact that the electromechanical concept of the virtual master axis is implemented in a consistent, rigorous manner.

This advantage is attained by the fact that at least one folder—starting from its initial state, in which the master axis and the position and/or condition of motion of the folder are independent of each other—adjusts (synchronizes) its initial state to (with) the setpoint value assignments of the master axis by performing compensating motions.

The folder is therefore synchronized from its initial state with the master axis (in particular, the higher-order, main master axis), in a dynamic manner, in particular. The initial state corresponds to a certain condition of motion and/or position state, that is, e.g., to a constant motion or rotation, or an (angular) position. In this initial state, the master axis and the position and/or the condition of motion of the folder are independent of each other. The drive is a possible reference element, i.e., the electric motor and driving unit of the cutting unit of a folder. Accordingly, the position and/or condition of motion of the cutting cylinder or the electric motor—as determined, e.g., via the actual value transmitter of the electric motor—would be a possibility for the position and/or condition of motion "of the folder".

The at least one folder is preferably synchronized while moving, i.e., in the condition of motion, in particular during the condition of motion, also preferably dynamically.

Via the present invention, the folder is incorporated entirely, as a slave, in the overall concept of a virtual master axis of a web offset printing press. The dynamic performance is improved by the fact that a (higher-order, in particular) master axis models and/or controls the entire behavior, and is not dependent on a certain assembly. In addition, the flexibility of the configurability is increased by the fact that, e.g., more folds, i.e., several production runs in particular, can be synchronized, and which must be cross-referenced with each other before the start of production can now be easily incorporated into the overall concept.

In particular, any initial motion setpoint values can also be specified in terms of dynamic performance (and not based, e.g., on the kinematic limitations of the folder).

For example, a web could also be divided longitudinally during the production process or before the production process or after the production process, and the resultant subwebs can be subsequently transported to different folders. In this case, the particular flexibility of the present invention is demonstrated by the fact that this configuration can be realized immediately with the method according to the present invention.

When, at least during synchronization of the folder, the transport elements that transport into this folder receives specific setpoint value assignments based on the folder, which deviate—at least occasionally—from the course of the setpoint value assignments of the at least one master axis and follow these specific setpoint value assignments, so that the transport elements perform—during synchronization of the folder—a motion that is synchronous—in terms of angle and/or speed—with the motion of the folder carried out during synchronization, then excessive web tensions, a tearing of the web, or a slack sheet or a loop formation, a bend or any other type of impairment of the material web are prevented or minimized even after the material web is loaded, particularly when the mechanical configuration is more sluggish. In addition, the transport elements are then coupled to the crucial folder and perform motions that are not excessive, such as synchronizing the printing units to a virtual master axis. As a result, the transport elements are synchronous (in terms of speed and/or time) with the relevant folder practically automatically and in every instant, and the printing units perform a specific synchronization motion independently and without limitations, which can be impressed upon the virtual master axis, e.g., by the folder and/or transport elements.

To this end, groups of transport elements are formed, in particular, which transport into the synchronizing folder. The specific setpoint value assignments are related to the folder such that, in particular, the transport elements that receive these specific setpoint value assignments perform a motion, during synchronization of the folder, that is synchronous—in terms of angle and/or speed—with its motion performed during synchronization.

The transport elements can be controlled in terms of position and/or speed, in particular. When they are controlled in terms of speed, they can also receive position setpoint value assignments, which can be used to derive the speed values for the drives. When the transport elements are speed-controlled, any offsets of the transport elements are dropped; accordingly, they do not complicate the control and/or reference control procedure. This is possible with the transport elements named above in particular, because they do not usually have to have a register relationship with the material web, and particularly not an unambiguous positional reference. Preferably, the transport elements do not process the material web, nor do they print on it.

Preferably, only—that is, exclusively—those transport elements that transport into the particular folder receive the specific setpoint value assignments named above. Other transport elements of the web offset printing press, which transport into another folder, receive other specific setpoint value assignments, for example, which are based on the other folder. The main point is that, by way of the configuration provided, autonomous groups of transport elements are formed, which do not affect the other assemblies, drives, and parts of the web offset printing press. In particular, the printing units can carry out their own synchronization procedure freely and independently of the folding motion and independently of the transport element motion.

Excessive stress on the material web is attained reliably and without negatively affecting the printing result by the fact that the specific setpoint value assignments correspond with an instantaneous position and/or instantaneous speed of the folder. A simple design is given when the specific setpoint value assignments are derived—continually, in particular—from the actual value of a position pick-up of the folder. This can be a position pick-up on an electric motor of the folder, e.g., the cutting cylinder. "Continual" can mean a realtime-derivation and forwarding of the setpoint value assignments.

The control and drive configuration of a web offset printing press is utilized particularly efficiently by the fact that the specific setpoint value assignments are derived from the initial state of the folder. The logistics of the control and drive system—which are present anyway—are utilized very efficiently in this case. It is provided, in particular, that the specific setpoint value assignments are generated from a specific master axis with an electronically generated synchronization clock; the folder also follows the specific master axis, and the starting value of the specific master axis corresponds to the initial state of the folder, and wherein the specific master axis is synchronized dynamically with the master axis. Configuration is then very easy to carry out, since the folder—like all of the other assemblies—follows the specific master axis (as the slave). A modern control and drive system is suited as is for synchronizing a specific master axis with the master axis dynamically, in terms of the motion in particular.

The method has a particular simple design in terms of equipment when, before the folder is started up, the actual value of a position pick-up of the folder is read out, and the starting value is derived therefrom, in particular wherein a control—in particular SPC, and/or a control system, in particular SPC of the control system—that is included in a drive-related control controls the reading out and derivation of the actual value. This means that a control or a control system, e.g., initiates the reading-out process or reads out the actual value from the position pick-up itself, and initiates, controls or performs by itself the process of deriving or forwarding the actual value to the drive-related control, which generates the specific master axis. The drive-related control can then be relieved of these tasks, both in terms of capacity and equipment (i.e., the drive-related control or its modules do not have to foresee a functionality of this type; if it is available, it does not have to be used).

The embodiments of the method described above are usable in general with a web offset printing press. With a particularly comprehensive machine design, e.g., with a great deal of inertia due to the high masses involved, or to improve the flexibility of the configurability or set-up times, it is provided that the material webs are inserted into the transport elements while the folder is synchronized, and that the transport elements transport these material webs right away.

To make the most efficient use of the required synchronization time during this procedure, it is provided that, during synchronization of the folder, all nips of the printing units or printing unit assemblies that operate in this folder are opened, and the material webs are guided into the transport elements, and the transport elements transport these material webs right away.

If the webs have already been guided into the folder by the superstructure and all draw-in mechanisms before production is started, the folder should no longer move independently for the synchronization. There is a risk that the webs will be torn by this motion, because all of the rollers used to transport the web through the machine—the drawing rollers in the infrastructure, in particular, possibly the draw-in mechanisms and the merging drawing roller upstream of the cutting cylinder, if it has a single drive—do not move with equal web distances in accordance with the angle corrected by the angular offset.

In the related art described initially, the mathematically calculated value of the virtual production master axis is set once (master axis preset) to the position of the folder—which it assumed when the machine was at a standstill—before the machine is started up. It is no longer necessary to synchronize the folder to correct the folding position before production is started when this set position of the virtual master axis corresponds to the position of the cutting cylinder and, therefore, the cutting register. In this case, the angular offset for the folder $\phi_F$ is zero. The webs are therefore reliably prevented from being torn. The disadvantages described initially are put up with, however, and they are eliminated with the present invention, even when material webs are drawn in.

The claimed means of attaining the object of the present invention is a generally usable method for presetting the cutting register in the machine, and it can be used for regular production with one folder, and for special production situations with divided webs that are directed to two folders.

The solution according to the present invention attains its flexibility by the fact that all individually driven draw-in mechanisms and transport elements on the webs are incorporated in the synchronization procedure of the folder. They include, e.g.:

The drawing rollers in the superstructure, the drawing rollers upstream of the former, the merging drawing rollers upstream of the cutting cylinders, the draw-in mechanisms upstream of the printing unit assemblies, and, optionally, the reel changers.

All of these assemblies that help transport the web receive position setpoints, which are calculated such that they correspond identically—in terms of position and speed—to the motion of the folder during synchronization. With the solution known today, these draw-in elements only follow the position of the virtual production master axis, which can still be at a standstill when the folder is synchronized, or it can specify any machine speed. Due to the synchronous motion of folder and draw-in elements, however, no path differences result between these assemblies, when during synchronization. Path differences and the resultant stretching of the web result in increased tension in the web and ultimately cause on or all webs to tear.

The printing units or printing unit assemblies also make very efficient use of the time provided for synchronization when, during synchronization of the folder, the printing units or printing unit assemblies perform compensating motions to adapt their condition of motion and/or their instantaneous positions to the setpoint value assignments of the master axis. A master axis that remains practically uniform (based, e.g., on production or a folder) during printing operation is ensured by the fact that, after the folder is synchronized, the folder and the transport elements that transport into this folder follow the setpoint value assignments of the master axis. It is then no longer necessary to generate additional setpoint values during print operation, after synchronization of the folder and/or the transport elements.

It is particularly preferable when the printing press configuration, the at least one folder, which is synchronized dynamically, and, in particular, operating parameters that are relevant to the synchronization of the folder, are assigned by a higher-order control system. The higher-order control system can be a control station that includes, e.g., SPC. This control station communicates with the control and drive system of the printing press and delivers, e.g., operating parameters that are relevant to the synchronization of the folder, such as the speed of the master axis during start-up of the web offset printing press, limiting parameters for the motion of the drives, web travel setpoint values, etc. The control system also specifies printing press configurations and, therefore, the at least one folder, which is synchronized. The configuration and the folder, i.e., the different productions and their interactions, are specified by the higher-order control system.

It is also a further feature of the present invention to provide a web offset printing press for printing and processing at least one material web, comprising at least one folder; printing units and/or printing unit assemblies; transport elements for transporting the at least one material web through the web offset printing press into said at least one folder; means for electrically driving the at least one folder, the printing units and/or printing unit assemblies, and the transport elements and at least partially mechanically independently of each other and synchronizing during printing operation via setpoint value assignment of at least one master axis with an electronically generated synchronization clock; and means for adapting an initial state of the at least one folder to or synchronizing the initial state of the folder with the setpoint value assignments of the master axis, starting from the initial state of the at least one folder in which the master axis and the position and/or condition of motion of the folder are independent of each other, by performing compensating motions.

It should be emphasized that a drive-related control generates a master axis, and one or the same drive-related control is provided to generate a specific master axis based on the folder. This specific master axis can communicate the related drive-related control, selectively and at least temporarily, to at least one driving unit of the at least one folder, and/or to at least one driving unit of the transport elements that transport into the folder. Given a simple design of the communication topology, this results in efficient communication, and the advantages named above are realized.

The present invention is described in greater detail below with reference to exemplary embodiments, which are only schematic and, therefore partly instructive, in character.

The novel features of the which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
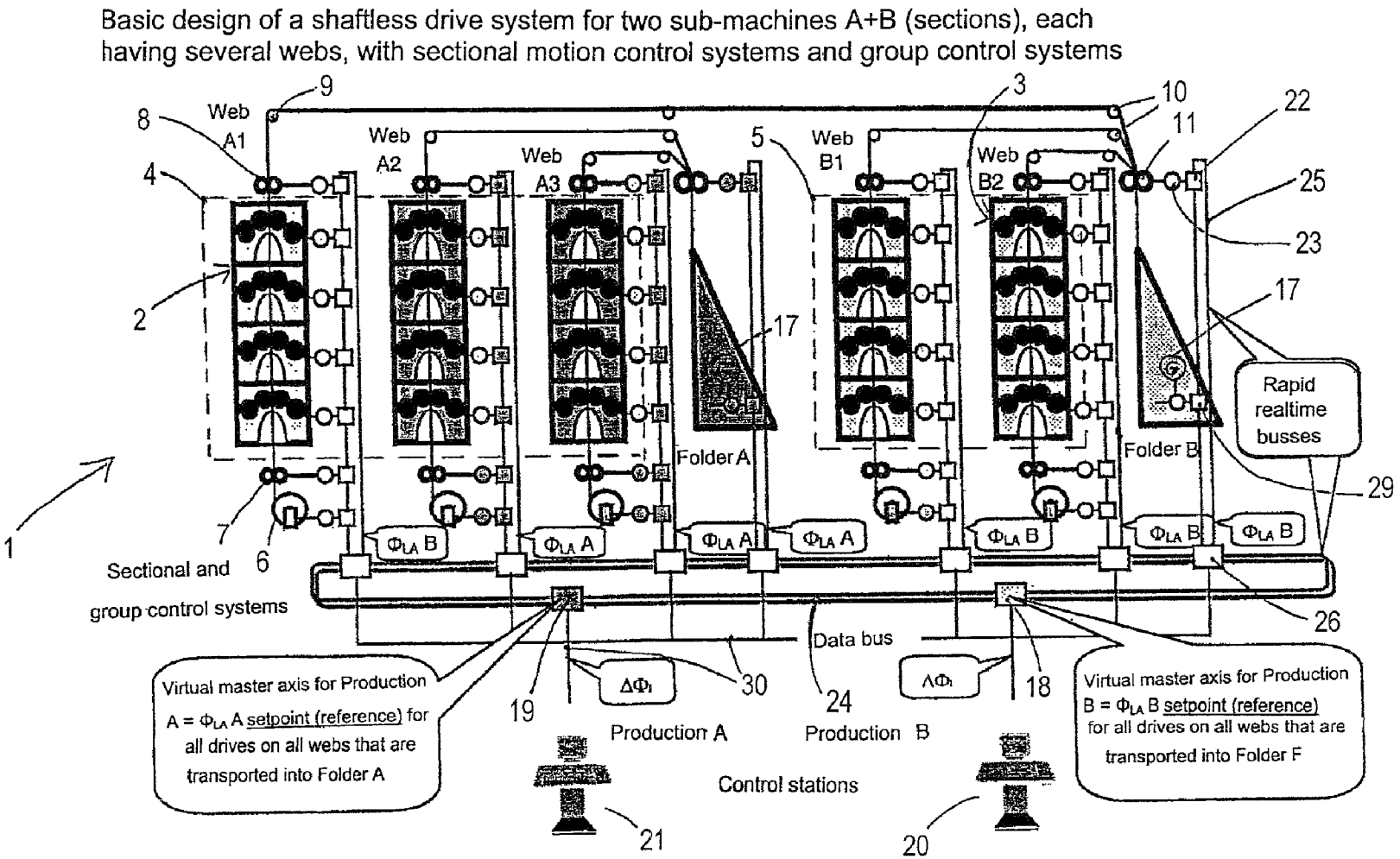
FIG. 1 is a rough schematic depiction of a web offset printing press with a drive and control device, which is also configured to carry out the method according to the present invention.

All of the figures listed above are merely roughly schematic, basic drawings provided for purposes of explanation. Unless stated otherwise below, all of the reference numerals refer to all of the figures in each case.

FIG. 1 shows an inventive web offset printing press 1, which is provided for printing and processing material webs A1, A2, A3; B1, B2, e.g., to cut and fold them, and to deliver them as a finished product. Folders A, B are provided for cutting, folding, and delivering. Printing units 2, 3, which form printing unit assemblies 4, 5, are provided for printing. Printing unit assemblies 4, 5 can each provide, e.g., four printing units for a material web, which is to be printed in four colors.

Material webs A1, A2, A3; B1, B2 are transported via transport elements 6, 7, 8, 9, 10, 11 through web offset printing press 1 into the at least one folder A, B. Transport elements in this sense are, e.g., reel changer 6, draw-in mechanism 7, draw-in mechanism 8, drawing rollers 9, 10, and merging drawing rollers 11. These elements are referred to as transport elements 6 through 11 for simplicity, even though a roller, for example, is not a transport element in the classical sense. The same applies, e.g., for a dynamic web reservoir, which is not shown here.

Folders A, B, printing units 2, 3, printing unit assemblies 4, 5, and transport elements 6 through 11 are electrically driven at least partially mechanically independently of each other. This means, in particular, that individual or all of the elements listed are driven mechanically independently of each other. Coupling between individual elements can take place using mechanical gearboxes. During printing operation, the elements, which are driven mechanically independently of each other, are synchronized via setpoint value assignments of at least one master axis 12, 13 (see FIGS. 2 through 4) with an electronically generated synchronization clock.

The mechanically independent elements (which, in particular, are not operatively interconnected via couplings, mechanical shafts or axes, or mechanical gearboxes) are driven individually or in combined groups of elements using one electric motor 23 each, the motion control and power supply of which is ensured by associated driving units 22, 29.

Since individual elements or groups of elements are electrically driven mechanically independently of each other, in order to ensure proper printing and processing, they must be in relationships with each other that are specified by the web offset printing press configuration, i.e., they must be synchronized. To this end, the synchronization clock, which is generated electronically, e.g., in a drive-related control 18, 19, is transmitted via a rapid realtime bus 24 (lateral communication) to other drive-related controls 18, 19, 26. Some of the drive-related controls 26 then transmit the communicated synchronization clock—also in real time—to associated driving units 22, 29 of the elements or assemblies, via rapid realtime bus 25 (drive communication line).

The busses can be based on the SERCOS standard, for example.

The entire web offset printing press configuration can be designed very flexibly. In the exemplary embodiment shown in FIG. 1, printing unit assembly 4 shown on the far left processes material web A1, which is transported to folder B, while the two printing unit assemblies located to the right of printing unit assembly 4 process web A2, A3, which is transported to folder A. Each of the other two printing unit assemblies 5 operates into folder B. This printing press configuration is specified by the basic mechanical framework (e.g., web A1 is tensioned by drawing rollers 9, 10 and transported into folder B). The entire printing press configuration is specified by control stations 20, 21. Control stations 20, 21 are connected with drive-related controls 18, 19, 26 via a communication line 30, which is not necessarily entirely realtime-capable. It can be, e.g., a communication line based on the ARCNET standard.

It is essential for the present invention that each of the material webs A1, A2, A3; B1, B2 merge into folder A, B in a predetermined manner according to the specified printing press configuration, where they are processed further, i.e., cut, folded, and delivered, in particular. The transport elements are provided for ensuring transportation through web offset printing press into folders A, B.

The description below refers to all figures simultaneously.

Upon restart after a production run, after set-up, production change, etc., all of the elements and assemblies are preferably in a certain state, in particular, they are in a certain position, i.e., rotary position, or they rotate at a certain speed. The present invention provides that at least one folder A, B—starting from its initial state 14—is synchronized with a (higher-order, in particular) master axis 12, 13, preferably dynamically. This means that the related folder, i.e., its drive, that is, its drive controller 29 and electric motor 23, performs compensation motions to match its initial state to the setpoint value assignments of master axis 12, 13. This can take place while folder A, B is moving. Folder A, B therefore adapts its initial state 14 to setpoint value assignments of master axis 12, 13, so that the folder and—after synchronization of all other, synchronization-relevant elements—the other elements of web offset printing press 1 operate synchronously in the sense of the machine configuration, and a satisfactory printing and/or processing result is therefore attained.

In initial state 14, master axis 12, 13 and the position and/or the condition of motion of folder A, B are independent of each other. This means, in particular, that the present invention can also be used with practically any number of folders, e.g., with a divided material web (not shown), the sections of which are transported into two different folders.

Figure 2:
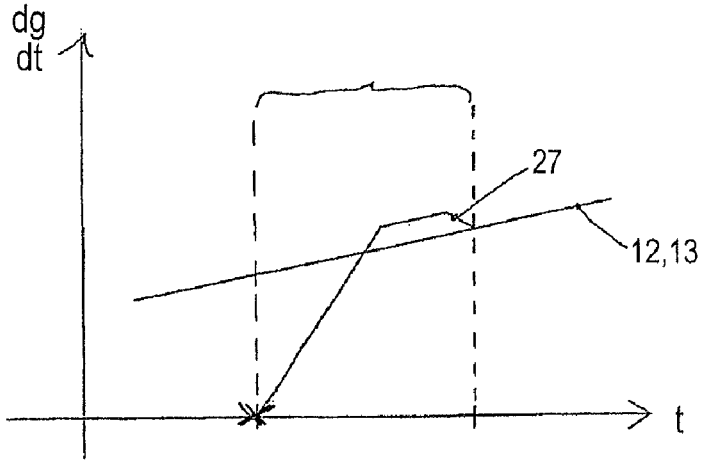
FIG. 2 is a rough schematic depiction of a synchronization procedure, shown as a graph of speed as a function of time.

The synchronizing procedure is shown in FIG. 2, for example. The start-up speed at an initial condition of motion 28 (which starts here, for simplicity, on the abscissa, that is, on the time axis, t) is faster than that of master axis 12, 13, and it continues, in particular, until a speed that is faster than that of master axis 12, 13 is attained. This slightly faster speed is maintained and—according to compensation motion graph 27—is subsequently adapted to the speed of the (preferably virtual) master axis 12, 13. Synchronization of speed has therefore taken place during this motion profile. Depending on the requirements (purely transport assemblies or processing or printing assemblies), one synchronization of speed or position is required or sufficient.

This synchronization of speed and/or angle/position has taken place during compensation motion interval 26, shown in FIG. 2.

According to the present invention, it is provided that transport elements 6 through 11, which transport into this folder A, receive specific setpoint value assignments 15, 16 related to folder A, B, at least during synchronization of folder A, B. These setpoint value assignments deviate from the course of the at least one master axis 12, 13, at least occasionally. Transport elements—and preferably only, i.e., exclusively these transport elements 6 through 11—follow these specific setpoint value assignments 15, 16, at least temporarily. During synchronization of folder A, B, transport elements 6 through 11 therefore perform a motion that is synchronous in terms of angle (i.e., position) and/or speed with the motion that folder A, B makes during synchronization.

Figure 4:
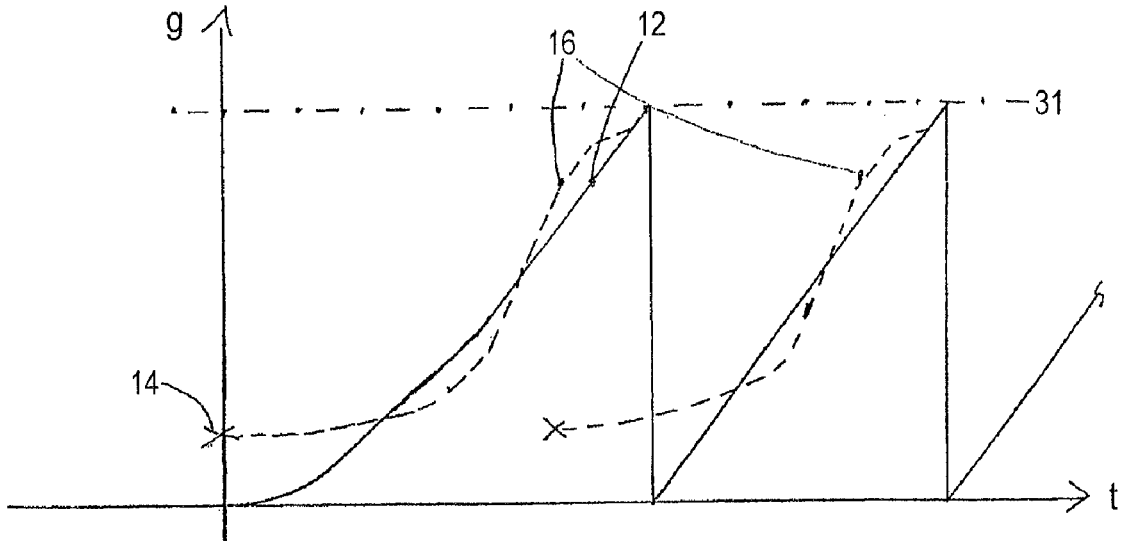
FIG. 4 shows a further, specific synchronization procedure, also shown as a graph of angle/position, as a function of time.

FIG. 4 shows an initial position 14 at a point in time "0" (selected at random in this case), at which the ordinate ($\phi$) intersects the abscissa (t). This corresponds to a certain angular position (not shown) of folder A, B. This angular position can be completely random, or it can result from shut-down during previous production. It is then possible for the position of master axis 12 to coincide with the initial position of folder 14. This is not the case here, however.

Starting from this initial state 14, folder A, B is synchronized with (preferably virtual) master axis 12. In this process, folder A, B operates practically synchronously with master axis 12 shortly before it reaches the upper limit (selected at random in this case) of the value range of master axes 12, 13, 15, 16. The upper limit of value range 31 could be, e.g., 360 degrees, or a digitized (quantized) representation of this degree reading; with multi-turn master axes, it is therefore possible to represent very high rpms, depending on the resolution. All degree readings, upper limits, synchronization behaviors, and curve shapes are presented here in a roughly schematic fashion and merely for purposes of explanation, and they can deviate from the shapes of curves over time that would result with an actual web offset printing press.

It is shown very basically in FIG. 4, for example, that the specific setpoint value assignments 16 (i.e., an "auxiliary master axis") are synchronized with master axis 12 at any point in time; at this point in time, the folder is also synchronized with master axis 12. Since transport elements 6 through 11 in FIG. 4 follow specific setpoint value assignments 16, which related to the folder, they are also synchronous with folder A, B during synchronization of folder A, B with master axis 12. As a result, excessive tensions, web tears or displacements can be prevented when, during synchronization of folder A, B, material webs A1, A2, A3; B1, B2 are already fed into transport elements 6 through 11, or they are already being transported by them. The nip between the diametrically opposed impression cylinders of printing units 2, 3 can be open during synchronization, i.e., material web A1, A2, A3; B1, B2 is guided freely through printing units 2, 3 and/or printing unit groups 4, 5.

It is also shown in FIG. 4 that folder A, B is synchronized by ramping up, i.e., the process is "gentle" and non-abrupt, in particular, and it starts with slow initial acceleration. Specific setpoint value assignments 16 for transport elements 6 through 11 are also shown.

Curve 16 on the right in FIG. 4 represents another state. It shows that folder A, B can also start synchronization at a later point in time, at which virtual master axis 12 has already started and has reached full speed. As for the rest, master axis 12 is also started in a "ramping-up" manner, to prevent unnecessarily high initial accelerations and an unnecessarily rough and damaging jolt.

FIG. 4 shows a specific setpoint value assignment 16, which is generated continually from the actual value of a position pick-up 17 of folder A, B when folder A, B is synchronized, for example. All of the references to angles, offsets, and other relationships of angles, positions, and speeds described initially are ignored in this depiction, for simplicity.

Figure 3:
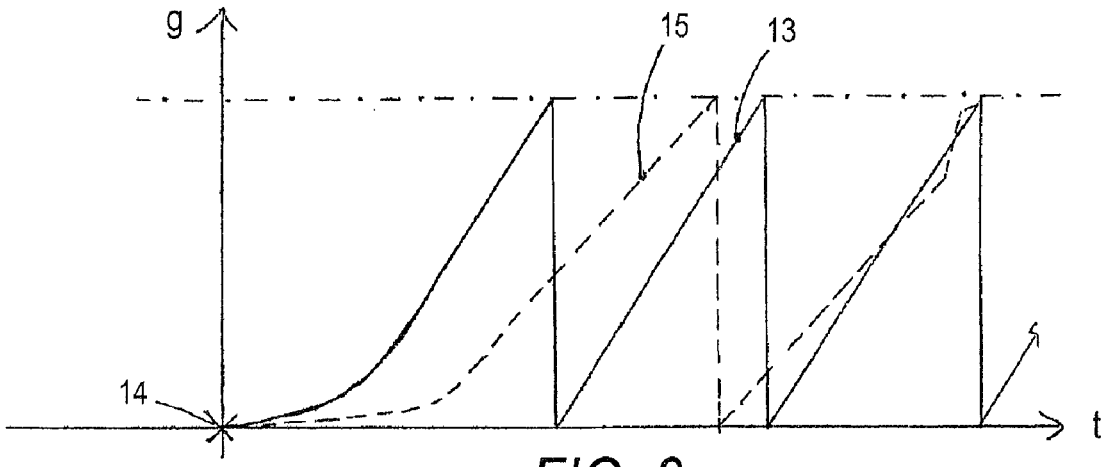
FIG. 3 shows a specific synchronization procedure, shown as a graph of angle, i.e., position, as a function of time.

Finally, FIG. 3 shows a specific setpoint value assignment 15, which contains, in addition to virtual master axis 13, a further visual master axis 15. Master axis 15 can be started, e.g., with an initial value of a folder A, B (and it is also "ramped up"). Folder A, B itself and transport elements 6 through 11 assigned to it can follow the specific setpoint value assignments of this further, virtual master axis 15. Via initialization of specific setpoint value assignments 15 with the initial position of folder A, B (e.g., of its position pick-up 17), folder A, B is immediately synchronous with specific setpoint value assignments 15. Likewise, all transport elements that follow specific setpoint value assignments 15 are synchronous with each other and with folder A, B. These specific setpoint value assignments are then adapted to the (virtual, in particular) master axis 13 (this is shown at the far right in FIG. 3; the synchronous state is also reached shortly before upper limit 31 of the value range). This shows that a virtual master axis can also be generated (15) that first "carries along" folder A, B and associated transport elements 6 through 11, they are all synchronized with each other, and this further virtual master axis 15 can also be synchronized with the other virtual master axis 13 (the "higher-order" master axis 13).

During the synchronization procedure, the nips—as stated above—in particular, the nips of the printing units that operate in the related, synchronizing folder A, B—can be open. The parameters are preferably specified by higher-order control system 20, 21—control stations 20, 21 in this case—via communication line 30. Higher-order control system 20, 21 also specifies the at least one folder A, B that is synchronized at all, and in particular, how, with what type of ramping up, at what speed, with what maximum speed, etc. it is synchronized. This is programmed, e.g., in the SPC (programmable) controller of particular control system 20, 21.

It will be understood that each of the elements described above, or two or more together, may also find a useful application in other types of methods and constructions differing from the type described above.

While the invention has been illustrated and described as embodied in a web offset printing press and method for operating a web offset printing press, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of operating a web offset printing press that prints and processes at least one web of materials, comprising the steps of:

providing printing units and/or printing unit assemblies, with at least one folder, and with transport elements;

transporting the at least one web of materials by the transport elements through the printing press into the at least one folder;

electrically driving the at least one folder, the printing units and/or printing unit assemblies and the transport elements at least partially mechanically independently of each other;

synchronizing during printing operation, specified setpoint value assignments, at least one master axis (13) with an electronically generated synchronization clock of at least one drive-related control;

generating, prior to synchronization with the at least one folder and the transport elements in an initial state, a specific master axis based on the position and/or condition of motion of the at least one folder, which said specific master axis deviates from a course of setpoint value assignments of the at least one master axis;

synchronizing, from an initial state, the transport elements and the at least one folder by synchronizing specified setpoint value assignments to the specific master axis, by performing compensation motions of the transport elements and the at least one folder during the compensation motion interval, such that the transport elements during the synchronization perform a motion that is synchronous with a motion of the folder in terms of a parameter selected from the group consisting of angle, speed, and both during the synchronization; and synchronizing the setpoint value assignments of the specific virtual master axis with setpoint value assignments of the master axis.

2. A method as defined in claim 1; and further comprising receiving the specific setpoint value assignment only by those of the transport elements that transport into the folder.

3. A method as defined in claim 1; and further comprising providing correspondence of the specific setpoint value assignments with a parameter selected from the group consisting of an instantaneous position of the folder, an instantaneous speed of the folder, and both.

4. A method as defined in claim 3; and further comprising deriving the specific setpoint value assignments from an actual value of a position pick-up of the folder, continuously.

5. A method as defined in claim 1; and further comprising deriving the specific setpoint value assignments from the initial state of the folder.

6. A method as defined in claim 5; and further comprising generating the specific setpoint value assignments from a specific master axis with an electrically generated synchronization clock;

following by the folder with the specific master axis;

providing correspondence of a starting value of the specific master axis to the initial state of the folder; and synchronizing the specific master axis dynamically with the master axis.

7. A method as defined in claim 6; and further comprising before the folder is started up, reading out an actual value of a position pick-up of the folder;

deriving the starting value therefrom; and controlling the reading out and the deriving by a control included in a drive-related control.

8. A method as defined in claim 7; and further comprising using as the control a control selected from the group consisting of SPC, a control system, and both.

9. A method as defined in claim 8; and further comprising using in the control system a control configured as SPC of the control system.

10. A method as defined in claim 1; and further comprising during synchronization of the folder, guiding the related web of materials into the transport elements; and moving along the web of materials by the transport elements.

11. A method as defined in claim 1; and further comprising, during the synchronization of the folder, opening all nips of the printing units or printing units assemblies that operate in this folder;

guiding the related web of materials_into the transport elements; and already transporting the web of materials_by the transport elements.

12. A method as defined in claim 11; and further comprising, during the synchronization of the folder, performing by the printing units or printing unit assemblies compensating motions to adapt parameters selected from the group consisting of their conditions of motion, their instantaneous positions, and both, to the setpoint value assignments of the master access.

13. A method as defined in claim 1; and further comprising, after the folder is synchronized, following by the folder and the transport elements that transport into this folder, the setpoint value assignments of the master axis.

14. A method as defined in claim 1; and further comprising assigning the printing press configuration, the at least one folder that is synchronized, and operating parameters that are relevant to the synchronization of the folder, by a higher-order control system.

* * * * *